United States Patent [19]

Stuhl et al.

[11] Patent Number: 4,821,747

[45] Date of Patent: Apr. 18, 1989

[54] PROCESS FOR TREATING TOBACCO AND SIMILAR ORGANIC MATERIALS

[75] Inventors: Oskar Stuhl, Düsseldorf; Klaus-Dieter Wenzel, Konz, both of Fed. Rep. of Germany

[73] Assignee: R. J. Reynolds Tobacco Company, Winston-Salem, N.C.

[21] Appl. No.: 30,800

[22] Filed: Mar. 27, 1987

[51] Int. Cl.[4] ..... A24B 3/18; A24B 15/22

[52] U.S. Cl. ..... 131/299; 131/291; 131/295; 131/296

[58] Field of Search ..... 131/296, 299, 294, 295, 131/291

[56] References Cited

U.S. PATENT DOCUMENTS

| | | | |
|---|---|---|---|
| 3,524,451 | 8/1970 | Fredrickson . | |
| 3,524,452 | 8/1970 | Moser et al. | 131/296 |
| 3,693,631 | 9/1972 | Moore et al. . | |
| 3,765,425 | 10/1973 | Stungis et al. . | |
| 3,828,797 | 8/1974 | Neumann et al. . | |
| 3,842,846 | 10/1974 | Laszlo . | |
| 3,870,053 | 3/1975 | Heitkamp et al. | 131/299 |
| 4,248,252 | 2/1981 | Lendvay et al. . | |
| 4,289,148 | 9/1981 | Ziehn . | |
| 4,333,482 | 6/1982 | Banyasz . | |

*Primary Examiner*—V. Millin

[57] ABSTRACT

Apparatus to expand shredded material, the latter is impregnated with an inert organic liquid which is evaporated subsequently. The substantial portion of the impregnant is separated. To eliminate the residual amount of impregnate still contained in the material, the material is fed in heaps on a conveyor belt (36) to a microwave chamber (39). Upstream and downstream of the microwave chamber, one sluice each (38,40) is provided. The gates (43,44;49,51) of the sluice are synchronized with the drive of the conveyor belt (36). Microwave energy is supplied under continuous control to the microwave chamber (39). The vapors are removed by suction lines (47,55) and fed to a regenerator for recovery of the impregnant.

3 Claims, 2 Drawing Sheets

PROCESS FOR TREATING TOBACCO AND SIMILAR ORGANIC MATERIALS

BACKGROUND OF THE INVENTION

The invention relates to a process for treating tobacco and similar organic materials, comprising impregnating the material with an inert organic liquid and heating it beyond the boiling point of said liquid by introducing a hot gas, whereby the liquid is evaporated while the material is expanded, after the expansion, recovering part of the evaporated liquid while a rest is left in the material.

Such a process has been known from German OS No. 19 17 552 and German OS No. 22 03 105. In said known processes, tobacco is impregnated with liquid or vaporous inert organic compounds. During a subsequent thermal treatment with gas vapour or steam, the impregnant is evaporated, while tobacco is expanded to be disaggregated and increased in volume. To reduce to a minimum the extraction of the soluble components normally present in the tobacco under treatment, the impregnating fluid, as introduced into the tobacco, should be in the vapor state. Thus, a reduction of the required amount of impregnant is possible as well. During the tobacco expansion, its filling capacity is increased by 60 to 120%. The impregnant evaporated during the expansion is evacuated together with the gas. From the mixture, the expansion agent may be recovered. It is disadvantageous in the known process that a residue of the impregnant is left in the expanded tobacco. To remove from the latter the residual amounts, the tobacco must be stored for some time until the impregnant has volatized. Such a storage is involved with a loss of time during the tobacco treatment and corresponding storage facilities as well as means for conditioning tobacco are necessary. The residual amount removed by storage is accessible but with difficulty for its recovery.

According to U.S. Pat. No. 3,828,797, tobacco expansion is performed in that the tobacco impregnated with a volatile organic liquid is subjected to a microwave treatment. The total energy required to evaporate the expansion agent is applied by microwaves. Such an energy-rich microwave treatment is extremely difficult on the large-scale basis, because, in case of a complete evaporation of the expansion agent, the tobacco material may be easily overheated. Practically, it is impossible to dose microwave energy such as to evaporate the expansion agent in total and not to overheat the tobacco for all that. Further, energy consumption of the known process is very high. While the process may be well performed under laboratory conditions, it is hardly practicable for use on a large-scale basis.

It is the object of the invention to provide a process of the above mentioned kind in which the residual amount of impregnant still present in tobacco after its expansion will be shortly removed therefrom without the need of an expensive tobacco storage.

SUMMARY OF THE INVENTION

The problem is solved according to the invention in that, after the expansion, the material (tobacco) is exposed to a microwave treatment, whereby the residue of the impregnant is evaporated and withdrawn for its recovery.

According to the process of the invention, the material under treatment is first expanded by evaporating volatile inert organic compounds, e.g. halogenated hydrocarbons, according to the process disclosed at the outset hereof. The expansion step is followed by the microwave treatment of the tobacco in order to remove therefrom the impregnant residues still present in it and to recover them accordingly. By the microwave treatment, the impregnant residue still present in the tobacco after the first process step is recovered rather than the impregnant in total. The removal of the residual amount which requires relatively low microwave energy is technically controllable. During the microwave treatment, no further expansion of the tobacco does occur, but only the residual amount of impregnant is removed.

To prevent the material from being dried during the microwave treatment, the material is previously humidified to a moisture content of 15 to 70%, preferrably of 18 to 40%. Upon termination of the microwave treatment, the material shall again show the usual average humidity of 10 to 16%.

The individual steps of the process of the invention are not only well controllable but also ensure a careful treatment of the material without the risk of thermal overloading. Further, the impregnant may be recovered quasi completely thus excluding practically any loss.

The invention further relates to an apparatus for microwave treatment which, on a large-scale basis, is feasible but with great difficulties, in particular in continuous operation, because the microwave chamber calls for a complete shielding. The invention permits to solve the problem of maintaining the shielding effect of a microwave chamber during continuous operation. According to the invention, there is provided a microwave chamber traversed by a conveyer belt and to which a suction line is connected. In the course of the conveyer belt, directly upstream and downstream of the microwave chamber, one sluice each is mounted which includes gates to be opened alternatingly. The conveyer belt extends through the gate openings. If the gate is closed the empty belt is movable through a gap of the gate opening.

Due to the sluices, the shielding of the microwave chamber may be maintained under any circumstances while a feeding to and evacuation from the microwave chamber is possible in continuous operation.

The process and apparatus for the microwave treatment according to the invention do not only lend themselves to the treatment of tobacco, but also to the expansion treatment of organic material in general, e.g. of seasoning agents.

BRIEF DESCRIPTION OF THE DRAWINGS

One embodiment of the invention concerning processing of tobacco will be now explained hereunder in more detail with reference to the drawings in which.

DETAILED DESCRIPTION OF THE PREFERRED EMBODIMENTS

Figure 1:
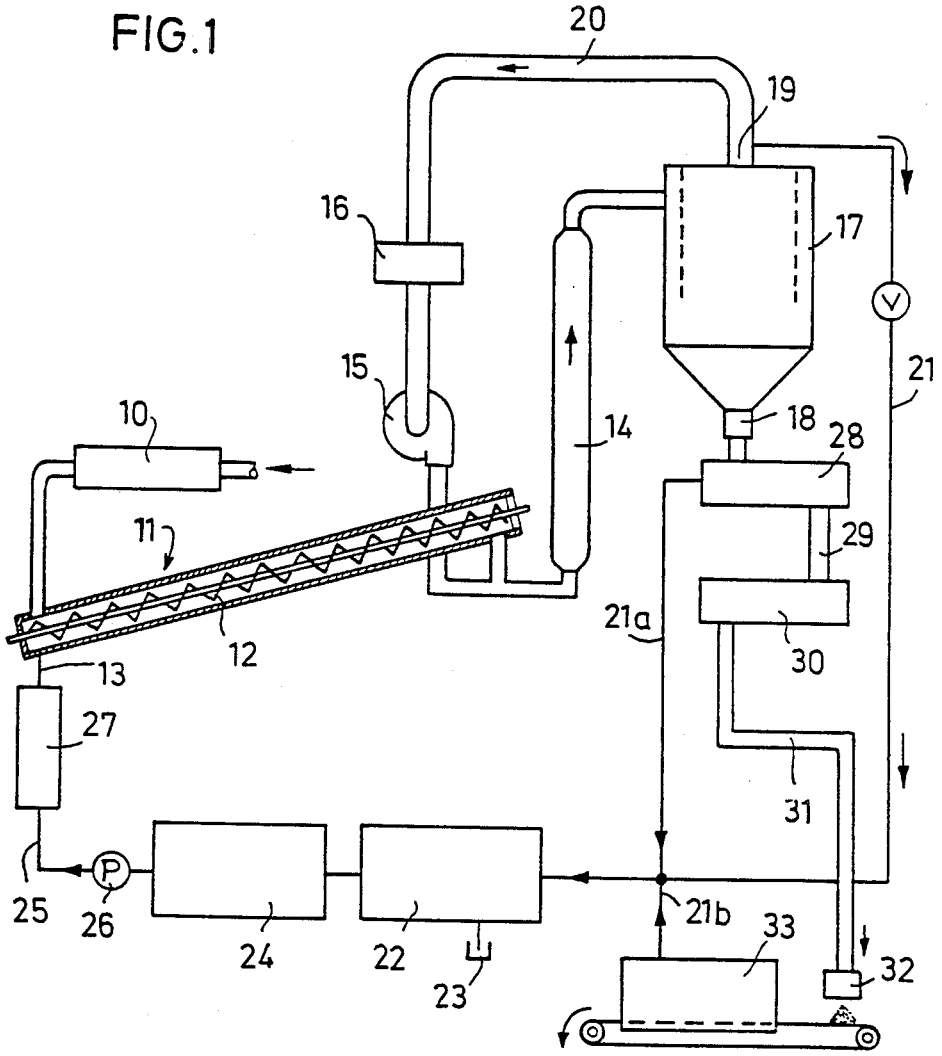
FIG. 1 is a schematic view of the total process.

As shown in FIG. 1, tobacco is supplied via a humidifier 10 to the impregnating device 11 which consists of a worm conveyer 12 into the inlet of which impregnant liquid is fed in addition to tobacco. Said liquid is supplied in vaporous state through line 13. Preferably, the inert organic liquid used consists of halogenenated hydrocarbons, e.g. trichlorofluoromethane (Frigen-11). Other inert organic liquids useful for the expansion are indicated in German OS No. 19 17 552 and German OS No. 22 03 105.

From the outlet of worm conveyer 11, tobacco gets to the expander 14 to which from a blower 15, hot steam is supplied which has been heated in heater 16. The temperature of steam (or of another gas used as a heat carrier), is above the boiling temperature of the impregnant which, as a result thereof, evaporates to cause in the expander 14 an increase in volume of the tobacco material.

Another line extends from the outlet of expander 14 to a cyclone 17 in which the tobacco drops to the lower outlet 18 while the gaseous components escape through the upper outlet 19.

From outlet 19, a return line 20 extends to heater 16. From said return line 20, there is branched off line 21 which extends to the regenerator 22 where the impregnant is removed from the vapor. The vapor components (water and air) are discharged into sump 23 while the impregnant is conducted into the reservoir 24 from which a line 25 including a pump 26 extends to the evaporator 27 whose outlet is connected to line 13, the evaporator 27 being responsible for the introduction of the impregnant liquid in vapor state into the impregnating means 11.

From the outlet 18 of the cyclone 17, tobacco is conveyed to a steam-operated separator 28 for the impregnant and from there, via a conveyer 29, to a conditioning drum 30. From the separator 28, further impregnant liquid still present in the tobacco is supplied through line 21*a* to the regenerator 22.

The device as specified above has been known from German OS No. 22 03 105. As for details of the equipment and of the first process step to be performed therewith, express reference is made to said citation which thus will be included into the contents of the instant disclosure.

From the outlet of the conditioning drum 30, a conveyer belt 31 extends to the portioning means 32 for the subsequent supply to the microwave device 33 where the second process step in the form of microwave treatment is performed.

In the conditioning drum 30, the moisture content of the tobacco is adjusted to 15–70%, preferably to 18–40%. The residence time of tobacco in said conditioning drum 30 is 0.5 to 3 minutes, preferably 0.5 to 1.5 minutes. The conveyer 30 extends to the portioning means 32 which consists of a container 34 (FIG. 2) tiltable about a horizontal axis to discharge via chute 35 to the conveyer belt 36 the tobacco forming there a heap 37. The drive of the conveyer 30 is so synchronized with the tilting control of the container 33 that a corresponding predetermined tobacco amount is introduced into the container 33 until it is filled as may be noted from a filling level detector. Subsequently, the conveyer 31 is stopped until the container 33 is emptied to subsequently reach again its receiving position.

The upper side of the conveyer belt 36 extends through sluice 38, microwave chamber 39 and sluice 40. Sluice 38 is formed of a chamber closed all round and consisting of a material adapted to constitute a shield against electromagnetic waves. The external wall of the chamber is provided with a gate opening 42 which may be closed by a shielding gate 43. The lower end of the gate opening is traversed by the upper side of the conveyer belt 36. The dimensioning of the gate opening 42 is such as to allow to move therethrough to sluice 38 a tobacco heap 37 present on the conveyer belt 36. As soon as the tobacco heap is present in sluice 38, the gate 43 is lowered to close the gate opening 42. Thereafter, gate 45 in the wall separating sluice 38 from the microwave chamber 39 is lifted so that the corresponding gate opening 44 is released. The conveyer belt 36 is driven again thus enabling the tobacco heap 37 to get into the microwave chamber 39.

By the microwave radiation sources 46, microwave energy is directed into the microwave chamber 39 to evaporate the impregnant present in the tobacco, and part of the tobacco moisture. By means of suction lines 47, and the exhauster 48, the evaporated components are removed from the microwave chamber to be supplied to line 21*b* extending to regenerator 22.

In sluice 38 and in the microwave chamber 39, the provision of moisture feelers and/or temperature feelers 41 permits to contactlessly measure humidity and temperature of the tobacco, their corresponding signals being processed in a control unit 53, e.g. a microprocessor in order to change microwave output or belt speed so that the tobacco which leaves the microwave chamber 39 contains a predetermined residual moisture while, on the other hand, overheating of tobacco is excluded.

The microwave chamber 39 is operated continuously, in other words, the microwave sources 46 are kept operative. The conveyer belt 36 is operated continuously and at a speed synchronized with the gate control. While gate 43 in sluice 38 is open, gate 45 is closed and vice versa, thus ensuring that the microwave chamber 39 is shielded at any moment against the environment, whereby microwave energy radiation is inhibited.

Responsive to the humidity and temperature of the tobacco, the microwave radiation sources 46 may be switched on or off individually or in groups by the control unit 53.

Sluice 40 at the outlet side also consists of a chamber traversed by the conveyer belt 36 and provided with a gate 49 in the wall separating it from the microwave chamber 39, the gate being adapted to close opening 50. The opposite wall includes gate 51 adapted to close opening 52, the movements of said gates 49 and 51 being also synchronized with the speed of the conveyer belt 36 and at least one of said gates being closed at any moment. Sluice 40 is longer than sluice 38 and forms an aftertreatment chamber from which humidity and residues of impregnant probably still existing may be sucked off.

Impregnant and humidity at the tobacco may evaporate in the sluices 38 and 40 which for sucking purposes are connected to suction lines 55 with exhausters 56. Said suction lines extend to line 21*b*. Instead of the exhausters 48 and 56, one may also provide a common exhauster in line 21*b*.

The gates of sluices 38 and 40 are so designed that, even with a closed gate opening, a narrow gap is still left for the passage of the conveyer belt 36 which thus may still move through a substantially closed gate opening. The underside of each gate may be provided with (non-illustrated) flexible guard plates of shielding material which, while they do not interfere with the conveyer belt movement, do not admit the passage of microwave radiation for all that.

The walls of sluices 38 and 40 as well as of the microwave chamber 39 and also the gates are made of material being gas-impermeable so that no vapors may flow into the open air.

Due to the advance of the conveyer belt 36 by a distance between two heaps, a tobacco heap 37 is conveyed into sluice 38, one tobacco heap is conveyed from sluice 38 into the microwave chamber 39, one tobacco heap is conveyed from the latter into sluice 40 and another tobacco heap is conveyed within sluice from one position to another position.

Figure 2:
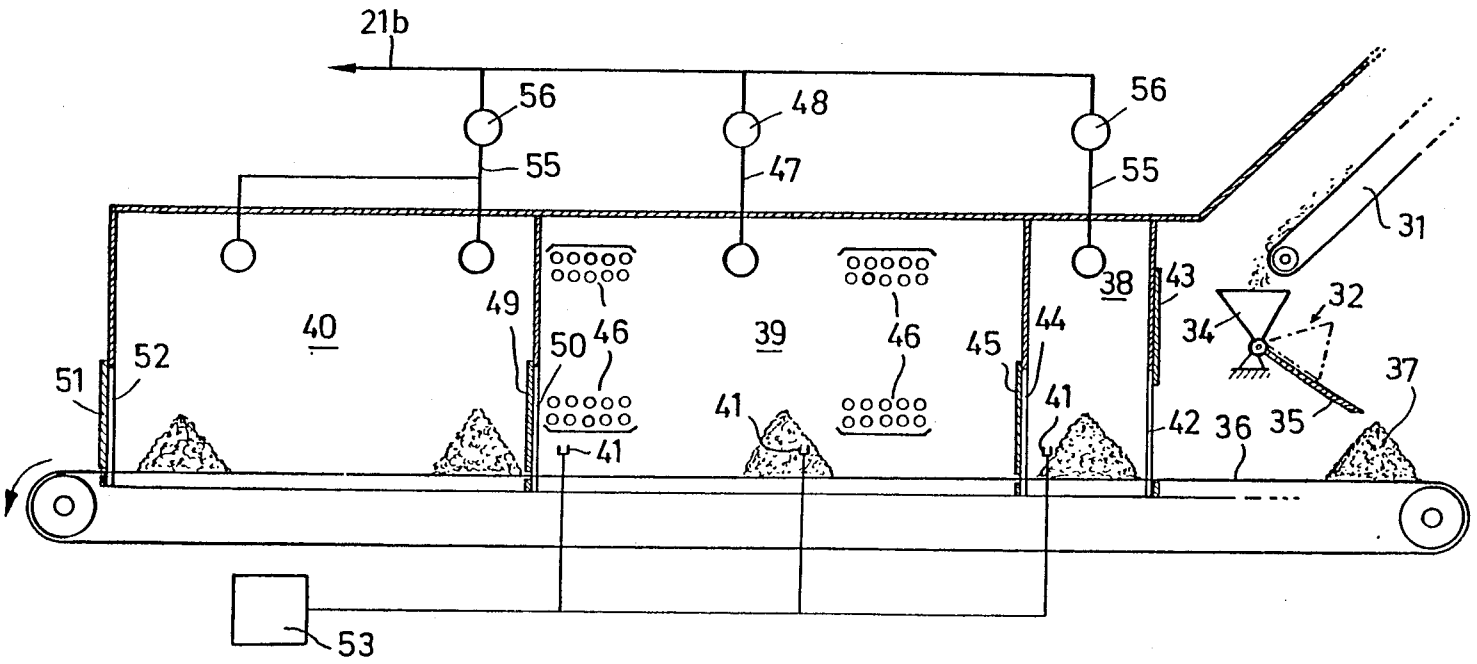
FIG. 2 is a schematic detailed view of the microwave equipment adapted to perform the second process step.

As an alternative to FIG. 2, it is possible to provide a control by which the sequence of tobacco heaps is closer to allow for more than one tobacco heap to stay in the microwave chamber 39.

It is possible to treat with the disclosed process tobacco or other organic materials in the form of shreds, strips, leaves, stems or from reconstituted leaves. The process is used preferably for treating shred material. The content of impregnant may be reduced to less than 1% of the residue still present after the first process step.

Unlike the microwave treatment in a microwave chamber provided with sluice chambers as disclosed above, it is also possible to realize the microwave treatment batchwise in a chamber to be disconnected for being opened.

What is claimed is:

1. Apparatus for treating tobacco and similar organic materials which previously have been impregnated with an inert organic liquid and heated above the boiling point of the inert organic liquid with a hot gas to produce expanded organic materials containing residual amounts of inert organic liquid, said apparatus comprising (a) a microwave chamber provided with a suction line for removing vaporized inert organic liquid from the chamber, (b) sluice means associated with the microwave chamber for introducing into and withdrawing from the microwave chamber the expanded organic materials, said sluice means including gate openings and pairs of cooperating gates adapted to be operated in an alternating fashion to close the gate openings at controlled intervals, (c) a conveyor belt provided with drive means for moving the belt through the microwave chamber and the gate openings of the sluice means, (d) feed means for depositing discrete heaps of expanded organic materials onto said conveyor belt for transport through the microwave chamber and sluice means associated therewith and (e) a source of microwave radiation for directing microwave energy into the microwave chamber to evaporate residual inert organic liquid contained in the expanded organic materials for subsequent removal by said suction line.

2. The apparatus of claim 1 wherein said conveyor belt is drive continuously and the operations of said feed means and said pairs of cooperating gates are synchronized with the conveyor belt drive means.

3. The apparatus of claim 1 wherein said sluice means is provided with a suction line for removing vaporized inert organic liquid from the sluice means.

* * * * *